US008246146B2

(12) United States Patent
Toda et al.

(10) Patent No.: US 8,246,146 B2
(45) Date of Patent: Aug. 21, 2012

(54) PRINTING HEAD

(75) Inventors: Kyosuke Toda, Hachioji (JP); Hideo Saikawa, Machida (JP); Keiichiro Tsukuda, Yokohama (JP); Takayuki Ono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 454 days.

(21) Appl. No.: 12/483,457

(22) Filed: Jun. 12, 2009

(65) Prior Publication Data

US 2009/0309926 A1 Dec. 17, 2009

(30) Foreign Application Priority Data

Jun. 17, 2008 (JP) ..... 2008-157901
May 25, 2009 (JP) ..... 2009-125607

(51) Int. Cl.
*B41J 2/135* (2006.01)

(52) U.S. Cl. ..... 347/44

(58) Field of Classification Search ..... 347/20
See application file for complete search history.

(56) References Cited

U.S. PATENT DOCUMENTS 6,170,940 B1 1/2001 Shinada et al.
6,419,347 B2 7/2002 Ono et al.
6,631,966 B2 10/2003 Watanabe et al.
6,676,245 B2 * 1/2004 Silverbrook ..... 347/54
RE38,710 E 3/2005 Goto et al.
7,063,411 B2 6/2006 Shyu et al.
2007/0006459 A1 1/2007 Ono et al.
2008/0259119 A1 10/2008 Ikegame et al.
2009/0102893 A1 4/2009 Tatsumi et al.
2009/0309923 A1 12/2009 Saikawa et al.
2009/0309927 A1 12/2009 Shimazu et al.

FOREIGN PATENT DOCUMENTS

JP 8-197750 8/1996

* cited by examiner

*Primary Examiner* — Matthew Luu
*Assistant Examiner* — Renee I Wilson
(74) *Attorney, Agent, or Firm* — Fitzpatrick, Cella, Harper & Scinto

(57) ABSTRACT

A printing head includes a printing element substrate that is hard to be deformed even if the printing head falls by mistake. The printing head comprises element substrate in which an energy generating element for generating energy used for ejecting ink is provided, a first sheet-shaped portion to which the element substrate is provided, a second sheet-shaped portion provided away from the first sheet-shaped portion at an opposite side to a direction of ejecting the ink in relation to the first sheet-shaped portion, and a sheet-shaped wall member connecting the first sheet-shaped portion to the second sheet-shaped portion, wherein the wall member has a thickness of a portion connected to the second sheet-shaped portion, which is larger than a thickness of a portion connected to the first sheet-shaped portion.

9 Claims, 9 Drawing Sheets

PRINTING HEAD

BACKGROUND OF THE INVENTION

1. Field of the Invention

The present invention relates to a printing head, and particularly, to a printing head using a resin material as a support member to which a printing element substrate in the printing head is bonded.

2. Description of the Related Art

A printing technology by an ink jet printing method is known as a quiet printing method which is low at running costs. For providing an ink jet printing apparatus at a lower price, it is effective to advance low pricing of a printing head which ejects ink droplets and occupies a high percentage among total costs of the ink jet printing apparatus. A printing element substrate which is a chip for ejecting ink is highly accurately positioned, attached and fixed on a surface with which a printing head is provided. In many cases of the printing head which has advanced the low pricing, the attachment surface on which the printing element substrate is attached and fixed is constructed of resin material. This is because it is possible to produce the printing head at a lower cost by using an injection molding technology as compared to a case where the attachment surface of the printing element substrate is constructed of a material other than the resin material, for example, a ceramic material.

Incidentally, for securing a printing quality at a high grade upon mounting the printing head to the ink jet printing apparatus, it is required to accurately maintain and control dimensions from a mount reference surface of the printing head to an orifice through which ink of the printing element substrate is ejected. Therefore, a high planarity is required on an attachment surface of the resin member to the printing element substrate. It is preferable to make uniform a molding contraction rate of a molding resin for the realization. Therefore, it is required to make uniform a thickness of a sheet-shaped portion of the support member to which the printing element substrate is attached, as much as possible. Further, for promoting cost cutting, in many cases, configurations of an ink passage for supplying the ink to the printing element substrate and a mount portion of a filter removing dusts in the ink are formed by support members made of the same resin member. In this case, a thickness of the sheet-shaped portion of the support member to which the printing element substrate is attached may be possibly increased. In general, a recess called a sink mark may be generated on a surface of a thick-walled portion in a resin component formed by injection molding. For preventing occurrence of such a recess on the attachment surface of the printing element substrate, a cavity portion is formed in a back side of the attachment surface of the printing element substrate and the wall thickness of the attachment surface is reduced. Therefore, it is possible to make uniform the thickness of the sheet-shaped portion of the support member to which the printing element substrate is attached. The printing head of such a construction is disclosed in U.S. Pat. No. 7,063,411. Since the cavity portion is formed in the above printing head, a physical strength of the wall constituting the cavity portion is degraded.

In consequence, in a case where, when the printing head in which the cavity portion is formed is mounted to the printing apparatus, the printing head falls from a high place by mistake and an impact shock is given on the above portion of the printing head in which the physical strength is weak, the printing element substrate provided in the printing head is deformed, possibly causing a printing defect.

Especially when the printing head which has fallen collides with a floor or the like, the attachment surface of the support member with the printing element substrate is deformed by the impact shock of the collision, thereby possibly damaging the printing element substrate. In this case, since the printing element substrate is attached and bonded to the support member by an adhesive or a sealant for sealing the periphery of the printing element substrate, the deformation of the attachment surface of the support member is supposed to deform also the printing element substrate through the adhesive or the sealant of the periphery in the printing element substrate. In this way, the deforming of the printing element substrate is undesirable for adversely affecting the printing quality.

Particularly, in a case where a rectangular ink supply opening penetrating through the printing element substrate is provided in the printing element substrate, when the printing element substrate is deformed by the impact shock given to the printing head, the deformation possibly affects further the printing grade. This ink supply opening is formed by an anisotropic etching process method and has corner portions. In consequence, the aforementioned deformation of the printing element substrate concentrates on the corner portion of the ink supply opening. When the stress to the corner portion due to the deformation is excessively large, a crack possibly occurs in the printing element substrate. The crack of the printing element substrate may cut wires or the like inside the printing element substrate to cause the printing defect.

SUMMARY OF THE INVENTION

The present invention is made in view of the foregoing problem and an object of the present invention is to provide a printing head in which a deformation amount of a printing element substrate is small even if the printing head falls by mistake.

In order to achieve the above object, the present invention comprises an element substrate in which an energy generating element for generating energy used for ejecting ink is provided, a first sheet-shaped portion provided to the element substrate, a second sheet-shaped portion provided away from the first sheet-shaped portion at an opposite side to a direction of ejecting the ink in relation to the first sheet-shaped portion, and a sheet-shaped wall member connecting the first sheet-shaped portion to the second sheet-shaped portion, wherein the wall member has a thickness of a portion connected to the second sheet-shaped portion, which is larger than a thickness of a portion connected to the first sheet-shaped portion.

According to the above construction, in a case where the portion of the wall member connected to the first sheet-shaped portion receives an impact shock, it is possible to increase rigidity of the wall member to deformation around a portion of the wall member connected to the second sheet-shaped portion as a supporting point. In consequence, by reducing the deformation of the first sheet-shaped portion, it is possible to reduce the deformation of the printing element substrate, improving reliability of the printing head.

Further features of the present invention will become apparent from the following description of exemplary embodiments (with reference to the attached drawings).

DESCRIPTION OF THE EMBODIMENTS

Hereinafter, embodiments in the present invention will be explained with reference to the accompanying drawings.

First Embodiment

Figure 1:
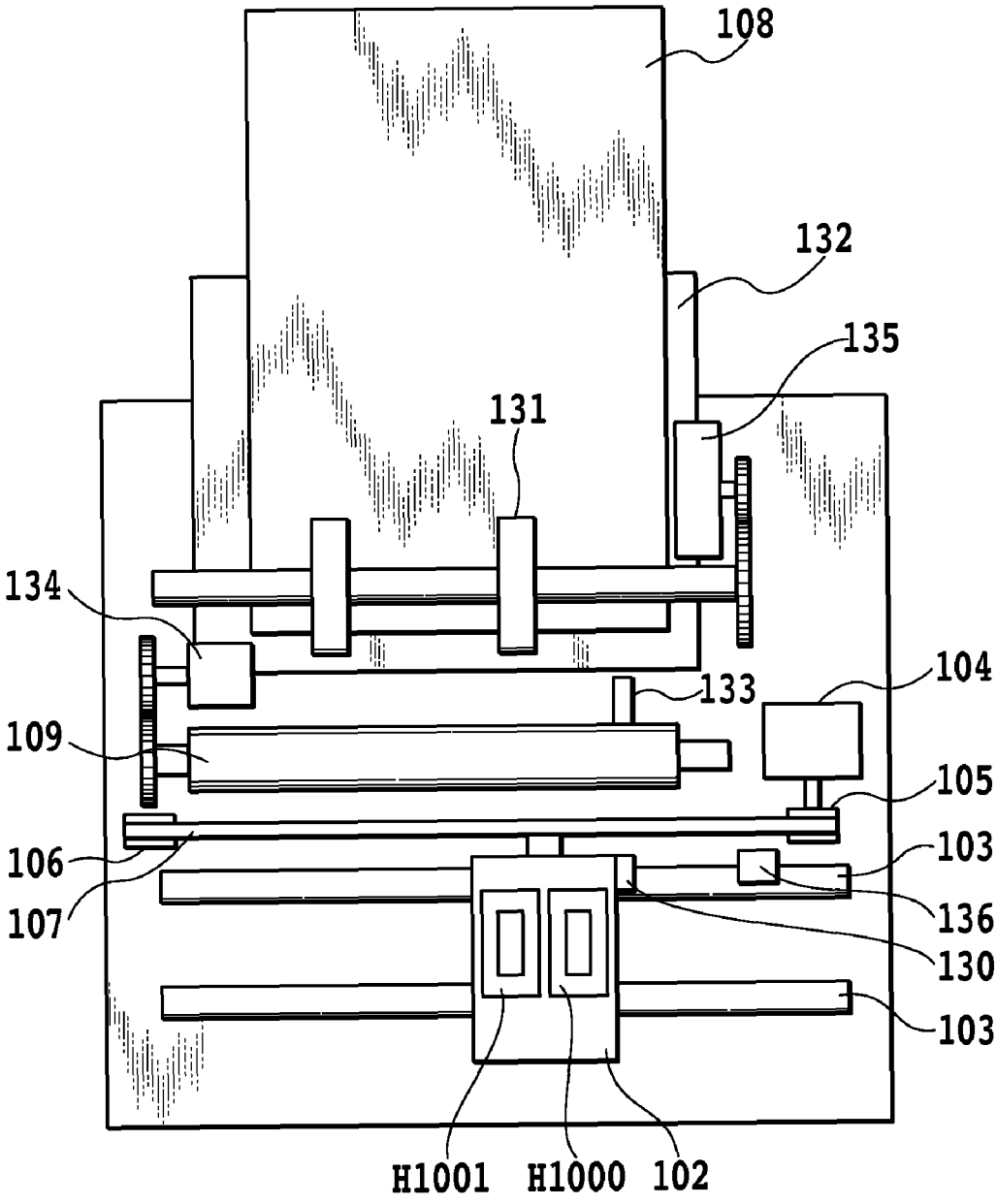
FIG. 1 is a diagram showing a schematic construction of an ink jet printing apparatus according to a first embodiment of the present invention.

FIG. 1 is a diagram showing a schematic construction of an ink jet printing apparatus in the present embodiment. The ink jet printing apparatus repeats a motion of reciprocating a first printing head H1000 and a second printing head H1001 in a main scan direction and a motion of conveying a printing medium 108 in a sub scan direction every predetermined pitch. Ink is ejected selectively from the first printing head H1000 and the second printing head H1001 while synchronizing with these motions to be attached to the printing medium 108, thus forming characters, signs, images and the like.

The first printing head H1000 and the second printing head H1001 are detachably mounted on a carriage 102. The carriage 102 is slidably supported by a guide shaft 103 and reciprocates along the guide shaft 103 by driving means such as a motor (not shown). The printing medium 108 is conveyed to face an ink ejection face of each of the first printing head H1000 and the second printing head H1001 by a conveying roller 109. The printing medium 108 is conveyed in a sub scan direction intersecting with the movement direction of the carriage 102 in such a manner as to maintain a distance between the printing medium 108 and the ink ejection face in a constant value.

The printing head in the present embodiment is integral with an ink tank where black ink is filled in the first printing head H1000 and ink of plural colors is filled in the second printing head H1001.

Figure 2:
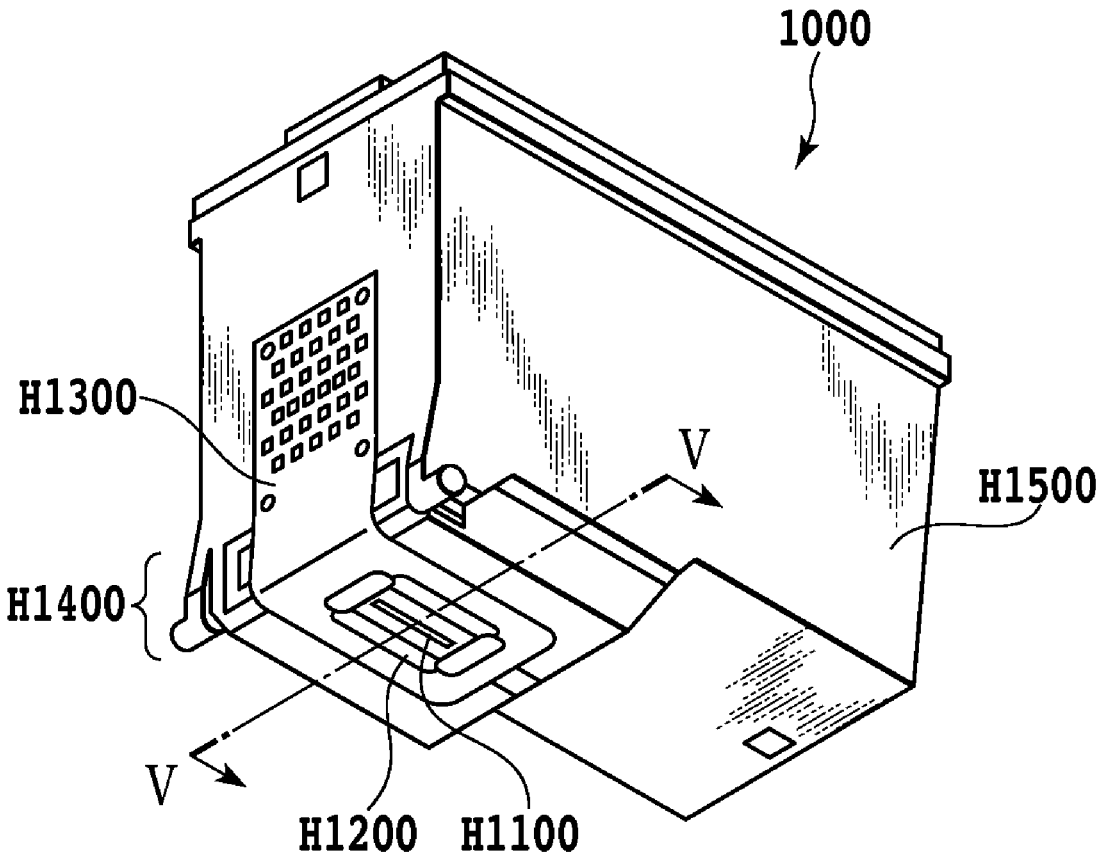
FIG. 2 is a perspective view showing a first printing head according to the first embodiment of the present invention.
Figure 3:
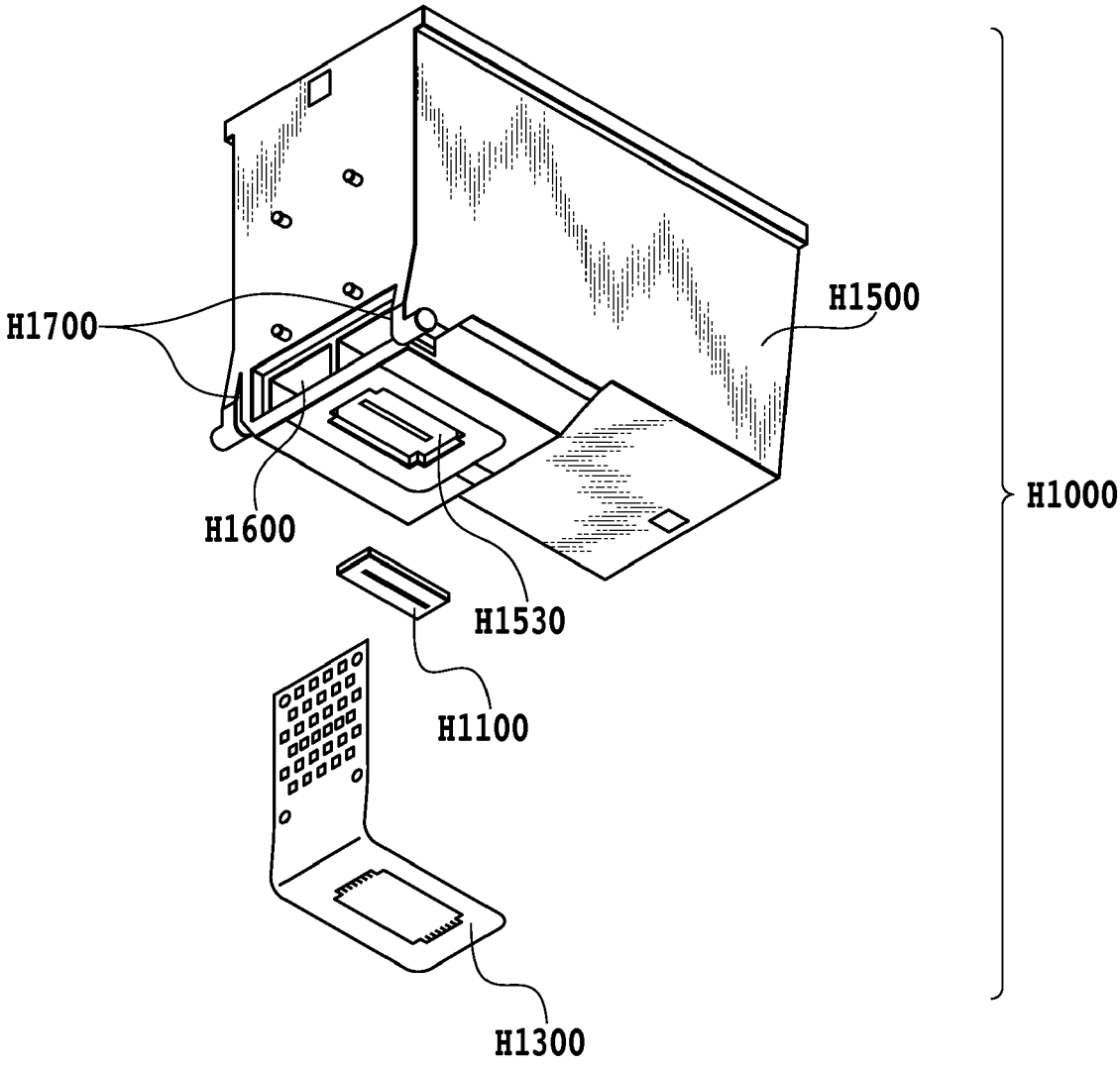
FIG. 3 is an exploded perspective view showing the first printing head according to the first embodiment of the present invention.

FIG. 2 is a perspective view showing the first printing head H1000. FIG. 3 is an exploded perspective view showing the first printing head H1000.

The first printing head H1000 includes a printing element substrate H1100 using a substrate made of silicon, an electrical wiring tape H1300, a support portion H1400 and an ink container H1500. The ink container H1500 includes an ink absorber for maintaining ink and generating a vacuum inside thereof, thus providing a function of an ink tank. The ink container H1500 is formed by, for example, resin molding. The ink container H1500 is provided with an ink passage formed therein for introducing the ink to the printing element substrate H1100, thus providing a function of ink supply. The periphery of the printing element substrate H1100 is sealed by a sealant of the printing element substrate periphery H1200. The electrical wiring tape H1300 supplies power to the printing element substrate H1100 and transmits a signal.

The support portion H1400 is a portion on which the printing element substrate H1100 is bonded by an adhesive, and includes a first sheet-shaped portion H1530 on which the printing element substrate H1100 is bonded, a cavity portion H1600 and a cavity portion wall H1700 constituting the cavity portion H1600.

The support portion H1400 is formed of a resin member and is manufactured so as to be integral with the ink containing portion H1500 by injection molding.

Figure 4:
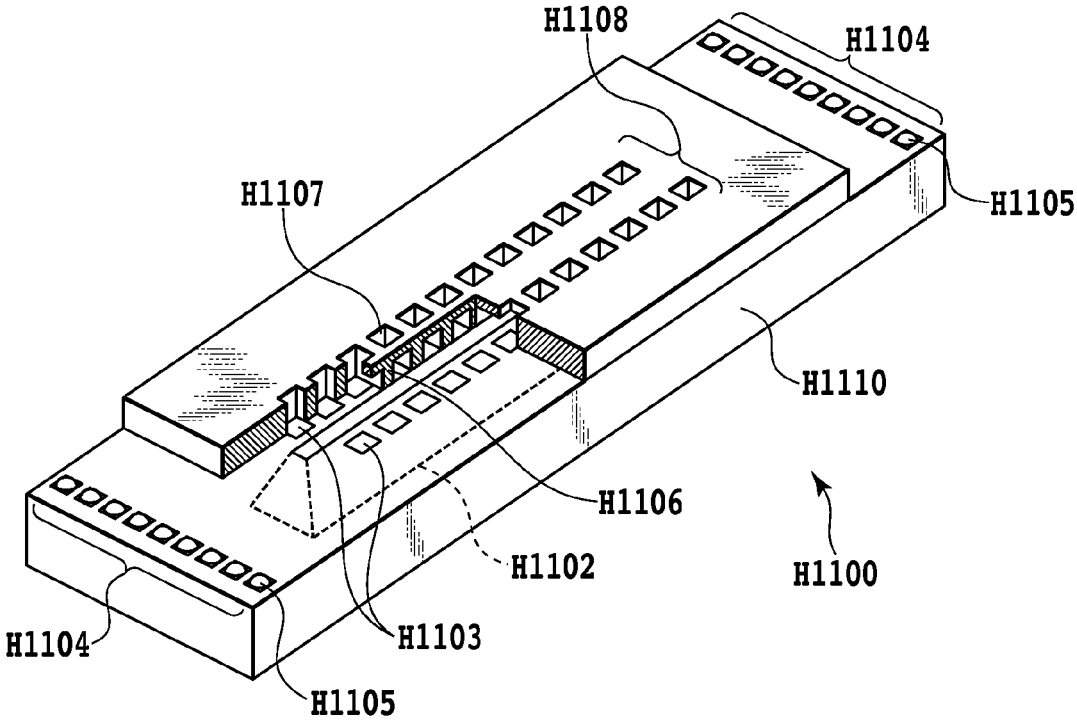
FIG. 4 is a broken perspective view showing a first printing element substrate according to the first embodiment of the present invention.

FIG. 4 is a broken perspective view showing the first printing element substrate H1100. In the Si substrate H1110, an ink supply opening H1102 of a through bore as an ink passage is formed. In the Si substrate in the present embodiment, the ink supply opening H1102 is formed by anisotropic etching of a wet type to have a quadrangular pyramid shape. One line of electricity-heat conversion elements H1103 is arranged in parallel at each side of the ink supply opening H1102, the electricity-heat conversion element H1103 serving as an energy generating element used for ejecting ink. The ink supplied from the ink supply opening H1102 is ejected from ejection openings H1107 opposing the respective electricity-heat conversion elements H1103 by pressures of air bubbles generated by heat of the respective electricity-heat conversion elements H1103.

Next, a structure for absorbing an impact shock due to the fall of the first printing head H1000 in the present embodiment will explained.

Figure 5:
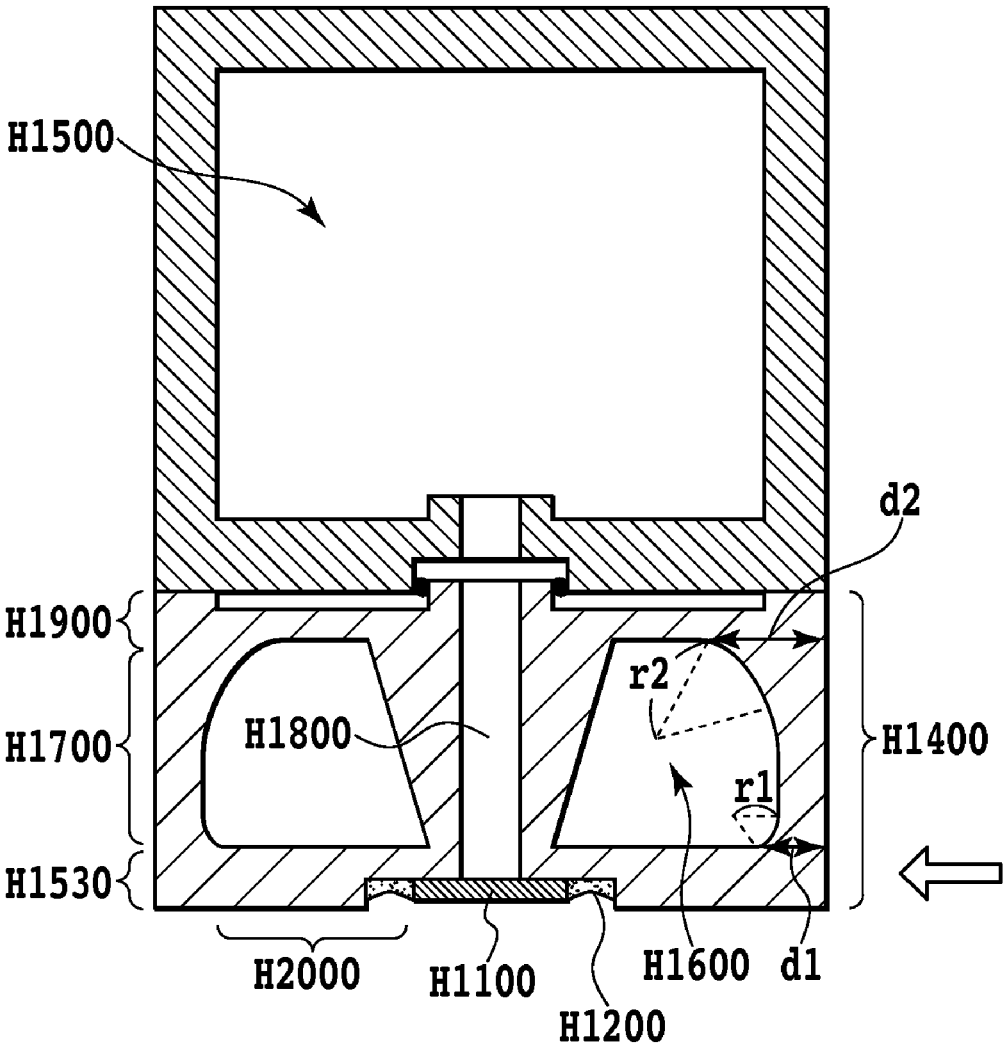
FIG. 5 is a cross-sectional view taken on line V-V in FIG. 2.

FIG. 5 is a cross-sectional view taken on line V-V in FIG. 2. The first printing head H1000 is constructed of the ink containing portion H1500, the support portion H1400 and the printing element substrate H1100. A space which constitutes an ink passage H1800 for supplying ink from the ink containing portion H1500 to the printing element substrate H1100 is formed inside the support portion H1400. The support portion H1400 includes the first sheet-shaped portion H1530, a second sheet-shaped portion (hereinafter, referred to as resin portion also) H1900 and the wall member (hereinafter, referred to as cavity portion wall also) H1700 constituting two cavity portions H1600 located in such a manner as to sandwich the ink passage H1800. The second sheet-shaped portion H1900 is provided away from the first sheet-shaped portion H1530 at an opposing side to a direction where ink is ejected from the ejection opening H1107 in relation to the first sheet-shaped portion H1530. The wall member H1700 is a sheet-shaped member connecting the first sheet-shaped portion H1530 to the second sheet-shaped portion H1900.

The cavity portion wall H1700 has a thickness which gradually increases and a cross-sectional configuration which increases in a curved shape toward the resin portion H1900. That is, the cavity portion wall H1700 has a portion connected to the resin portion H1900, which has a curved surface. A thickness d2 of the portion in the cavity portion wall H1700 connected to the resin portion H1900 is larger than a thickness d1 of the portion in the cavity portion wall H1700 connected to the first sheet-shaped portion H1530.

By thus forming the cavity portions H1600 in the support portion H1400, the first sheet-shaped portion H1530 connected to the printing element substrate H1100 requiring a high positioning accuracy in the support portion H1400 can maintain high dimension accuracy and planarity.

Figure 6A:
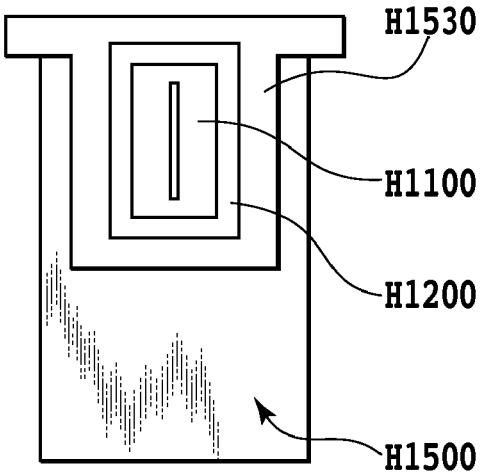
FIGS. 6A and 6B are diagrams each showing a conventional printing head and the conventional printing head which has received an impact shock, and viewed from the side where a printing element substrate is provided.
Figure 6B:
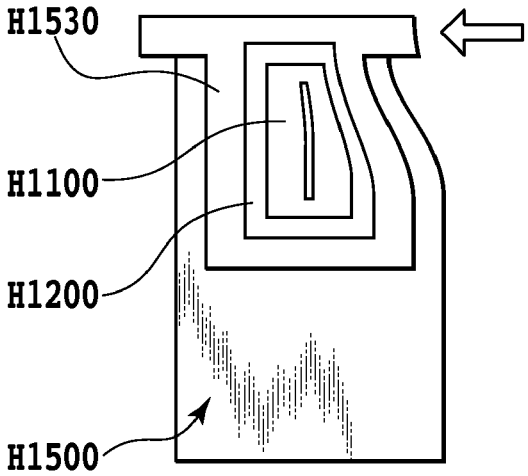

FIGS. 6A and 6B are diagrams each showing a conventional printing head and the conventional printing head which has received an impact shock, and viewed from the side where a printing element substrate is provided. In a case where the printing head H1000 receives an impact shock due to the fall from a high place, the conventional printing head shown in FIG. 6A is deformed as shown in FIG. 6B. In the conventional printing head, due to the deformation of the bonding face to which the printing element substrate H1100 is bonded as shown in FIG. 6B, the printing element substrate may be deformed through the sealant of the printing element substrate periphery H1200 or the adhesive, possibly producing a crack therein. Since in the conventional structure, the deformation of the bonding face to which the printing element substrate H1100 is bonded is made in such a manner that the cavity portion wall falls to the ink passage side by the impact shock because of the cavity portion, the deformation amount has a tendency of increasing.

However, in the support portion H1400 in the present embodiment, a thickness d2 of the wall in the cavity portion wall H1700 connected to the resin portion H1900 is larger than a thickness d1 of the portion in the cavity portion wall H1700 connected to the first sheet-shaped portion H1530. That is, the support portion H1400 is constructed so that the thickness of the portion connected to the resin portion H1900 as a fulcrum of the deformation is larger than the thickness of the portion of the cavity portion wall H1700 connected to the first sheet-shaped portion H1530 as a power point in a case of receiving the impact shock. With this construction, it is possible to increase rigidity of the cavity portion wall H1700 against the deformation made having the portion of the cavity portion wall connected to the resin portion H1900 as the fulcrum and the portion connected to the first sheet-shaped portion H1530 as the power point. Therefore, the deformation of the first sheet-shaped portion H1530 can be reduced, and it is possible to reduce the deformation of the printing element substrate H1100.

When a change of the thickness in the cavity portion wall H1700 is made in a curved shape as shown in FIG. 5, it is possible to form the cavity portion H1600 widely. Further, when the change of the thickness in the cavity portion wall H1700 is made in a curved shape, the stress concentration in the cavity portion wall H1700 by the impact shock can be avoided. Therefore, it is possible to further increase the rigidity of the cavity portion wall H1700 against the deformation.

As shown in FIG. 5, a thickness of a portion connected to the resin portion as a fulcrum of the deformation increases toward the inner side of the printing head. Thereby, it is possible to reduce increase of the width of the printing head and it is possible to increase rigidity against the deformation of the cavity portion wall H1700. In the case of forming by injection molding, d1 needs more than 0.4 mm to more easily flow the resin into a mold. d2 can be configured to the size of half of the width of a resin portion H1900 shown in FIG. 5 at the maximum. Preferably, moldability of a resin portion H1900 can be kept good by making d2 into the size of the resin portion H1900 of the width L to about ⅓.

As shown in FIG. 5, the cavity portion wall H1700 has a curvature in each of the portion connected to the first sheet-shaped portion H1530 and the portion connected to the resin portion H1900.

When, in relation to the cross section configuration of the cavity portion wall H1700, curvature radius r1 of a curve of the portion connected to the first sheet-shaped portion H1530 is preferably greater than or equal to 0.3 mm. In the present embodiment, r1=1.0 mm. Curvature radius r2 of a curve of the portion connected to the resin portion H1900 can be the size which minus r1 from height h of the cavity portion wall H1700 shown in FIG. 5 at the maximum. Preferably, moldability of a resin portion H1900 can be kept good by making r2 into the size of the resin portion H1900 of the width L to about ⅓. In the present embodiment, r2=2.5 mm.

It should be noted that in the present embodiment, it is preferable that the thickness d1 of the portion in the cavity portion wall H1700 connected to the first sheet-shaped portion H1530 is thin in some degrees. This is because a part of the first sheet-shaped portion H1530 between the bonding face of the cavity portion wall H1700 and the bonding face of the printing element substrate H1100 serves as the impact shock absorber H2000 which is a portion for absorbing the impact shock. When the thickness d1 of the wall is set substantially equal to the thickness d2 of the wall, a distance of the impact shock absorber H2000 is shorter by an increasing amount of the thickness d1 of the wall, leading to a reduction of an impact-shock absorbing performance.

That is, in the support portion H1400 of the present embodiment, the thickness d2 of the portion in the cavity portion wall H1700 connected to the resin portion H1900 is larger than the thickness d1 of the portion in the cavity portion wall H1700 connected to the first sheet-shaped portion H1530. Therefore, rigidity of the cavity portion wall against the impact shock in the falling-down direction to a side of the passage H1800 increases and thereby, the deformation of the first sheet-shaped portion H1530 due to the falling-down of the cavity portion wall H1700 is reduced. Further, the thickness d1 of the cavity portion wall H1700 is reduced to be thin to the extent that a crack does not occur due to the impact shock of the fall and a width of the impact shock absorber H2000 in the first sheet-shaped portion H1530 is as large as possible. Thereby, the deformation of the bonding face in the printing element substrate H1100 is further reduced.

Based upon the above construction, by setting a width of the cavity portion H1600 to be large, it is possible to maintain the planarity of the first sheet-shaped portion H1530 and also prevent an image degradation due to an ejection defect of the printing element substrate H1100 by the fall of the printing head H1000 or the like. Further, in a case of supplying ink of plural colors to the printing element substrate H1100, when a different member is inserted into the cavity portion H1600 to provide a new ink passage, a degree of freedom in the designing can be provided in the passage construction by setting the width of the cavity portion H1600 to be large.

It should be noted that in the present embodiment, the printing head integral with the ink containing portion is explained, but in the present invention, the printing head may be provided with the ink containing portion which is replaceable.

Modification of the First Embodiment

The support portion H1400 in the printing head H1000 of the first embodiment may be further provided with beams H2005 for reinforcing the bonding face of the printing element and grooves H2004 arranged in the cavity portions H1600.

Figure 7:
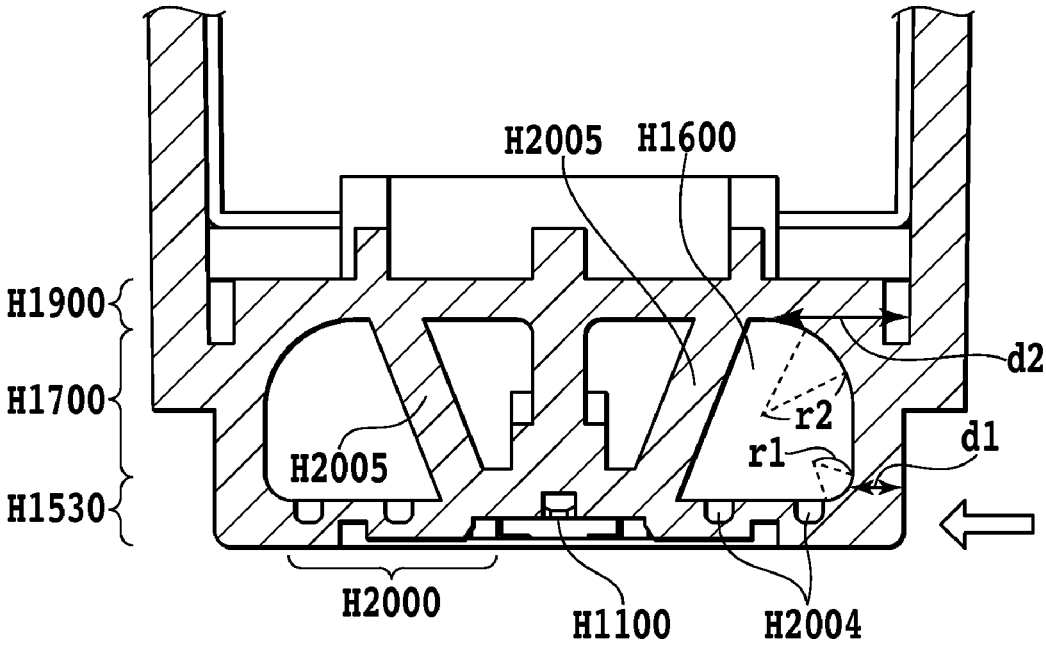
FIG. 7 is a cross-sectional view showing a cross section of a printing head in a modification according to the first embodiment of the present invention.

FIG. 7 is a cross-sectional view taken on line V-V in FIG. 2 showing a modification of the present embodiment. In the support portion H1400 in the printing head H1000 of the present embodiment, the cavity portions H1600 surrounding the ink passage H1800 are provided with two beams H2005. In addition, the impact shock absorbing grooves H2004 with a structure of more absorbing the impact shock are provided between the bonding face of the cavity portion wall H1700 and the first sheet-shaped portion H1530 and the bonding face of the printing element substrate H1100 and the first sheet-shaped portion H1530. The deformation can be further reduced against the impact shock by thus providing the beams H2005 and the impact shock absorbing grooves H2004.

Second Embodiment

In the configuration of the support portion H1400 in the printing head H1000 in the first embodiment, the cavity wall changes in a curved shape, but the present invention is not limited to this configuration.

Figure 8:
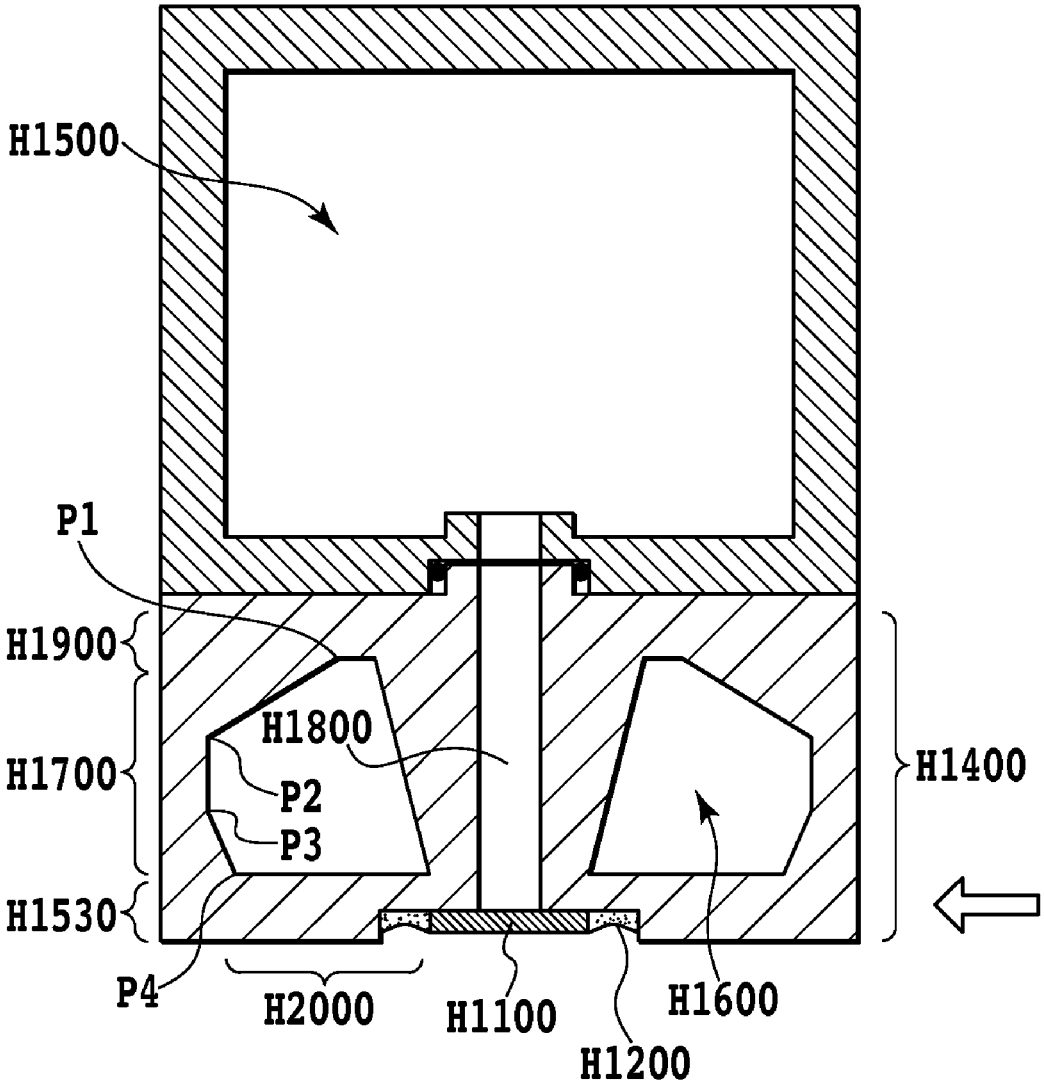
FIG. 8 is a cross-sectional view showing a cross section of a printing head according to a second embodiment of the present invention.

FIG. 8 is a cross-sectional view showing a cross section of the printing head H1000 in the present embodiment. A thickness of the cavity wall H1700 in the support portion H1400 in the present embodiment gradually increases toward the resin portion H1900 in the same way as in the first embodiment. A change in the thickness of the cavity portion wall H1700 is linear. That is, the change in the thickness of the cavity portion wall H1700 in the support portion H1400 in the first embodiment is curved, but the thickness of the cavity portion wall H1700 in the present embodiment simply increases toward the resin portion H1900 from any point p2 to point p1 in the cavity portion wall.

As in the case of the present embodiment, in a case of increasing or decreasing the thickness of the cavity portion wall H1700 linearly, it is easier to thicken the cavity portion wall H1700 than to increase or decrease the thickness of the cavity portion wall H1700 in a curved shape. However, because of the resin member manufactured by injection molding, as the cavity portion wall H1700 is not excessively thick, it is preferable to set the thickness of the cavity portion wall H1700 in a range as much as to be capable of maintaining the dimension accuracy and planarity of the support portion H1400.

Modification of the Second Embodiment

In the support portion H1400 in the printing head H1000 in the present embodiment, the cavity portion wall H1700 may be further provided with different cavities.

Figure 9:
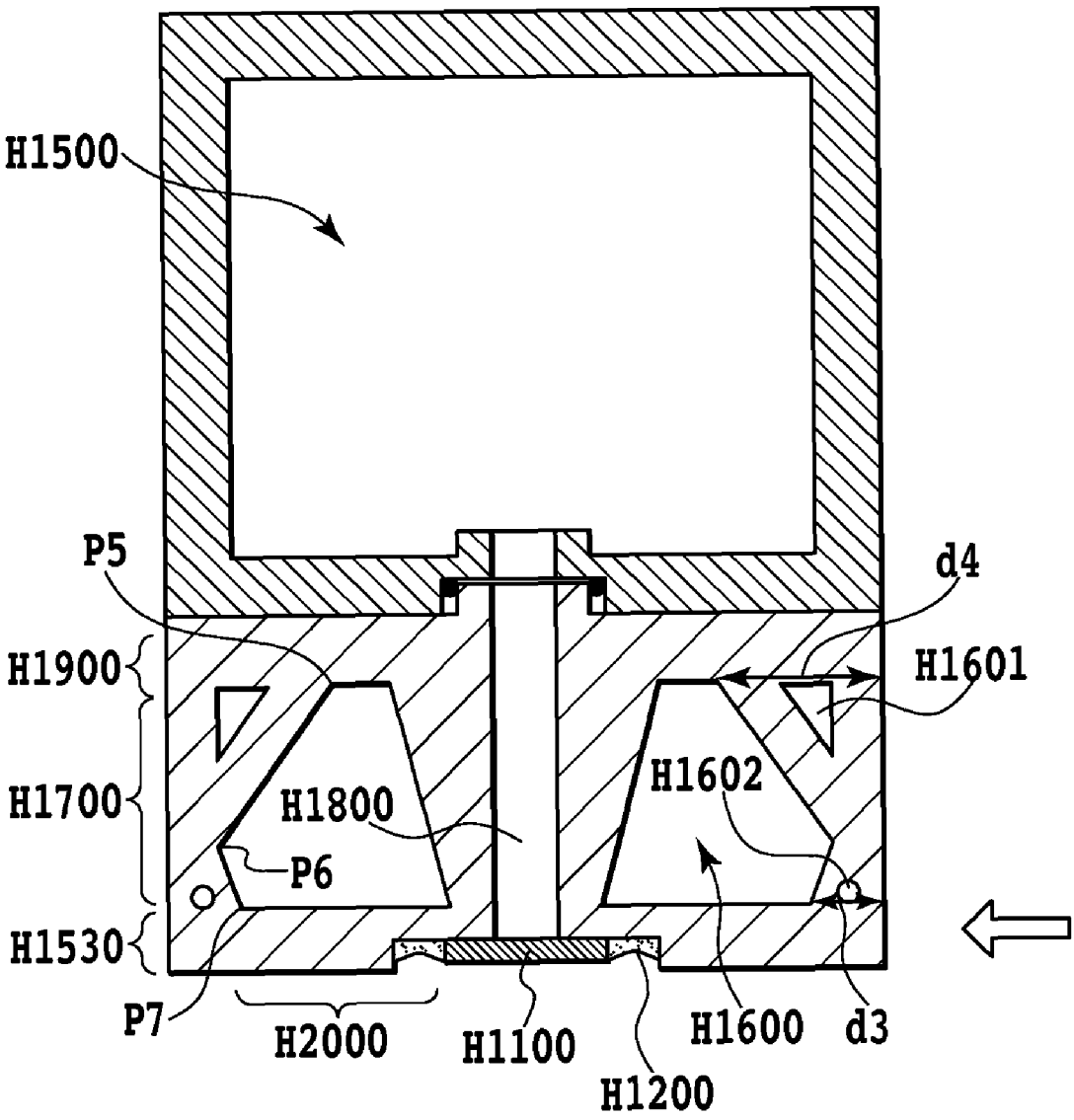
FIG. 9 is a cross-sectional view showing a cross section of a printing head in a modification according to the second embodiment of the present invention.

FIG. 9 is a cross-sectional view showing a cross section of a printing head H1000 in a modification in the present embodiment. The printing head H1000 of the modification in the present embodiment is provided with cavities H1601 arranged in portions in the cavity portion wall H1700 connected to the resin portion H1900. In the present modification, a thickness of the cavity portion wall H1700 simply increases toward the resin portion H1900 from any point p6 to any point p5 in the cavity portion wall. The thickness of the cavity portion wall H1700 has a relation of "thickness d3<thickness d4". By thus providing the cavity H1601 to the portion in the cavity portion wall H1700 connected to the resin portion H1900, the cavity portion wall H1700 can be uniformly cooled at resin-hardening, thereby maintaining the dimension accuracy and the planarity of the support portion H1400. In addition, cavities H1602 may be formed in the portions of the cavity portion wall H1700 connected to the first sheet-shaped portion H1530 for uniformly cooling the cavity portion wall H1700 at resin-hardening to maintain the dimension accuracy and the planarity.

In the modification in the present embodiment, a cross section of the cavity H1601 is a triangular shape, but the cross section of the cavity in the present invention is not limited to such a shape. That is, the cavity H1601 may adopt any configuration as long as it has a structure with an effect of increasing rigidity of the cavity portion wall H1700 and it meets conditions of a position, a configuration and a size which are important for a dimension accuracy of injection molding and have a cooling effect at resin-hardening.

Further, the cavity portion wall H1700 in the present modification has the thickness which simply increases toward the resin portion H1900 from a point p6 to a point p5, but the present modification may be applied to a structure in which the thickness of the cavity portion wall H1700 changes in a curved shape.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-157901, filed Jun. 17, 2008, and No. 2009-125607, filed May 25, 2009, which are hereby incorporated by reference herein in their entirety.

What is claimed is:

1. A printing head comprising:

an element substrate in which an energy generating element for generating energy used for ejecting ink is provided;

an ink containing portion storing ink for supply to the element substrate;

a first sheet-shaped portion to which the element substrate is provided;

a second sheet-shaped portion provided away from the first sheet-shaped portion and provided between the ink containing portion and the first sheet-shaped portion; and a sheet-shaped wall portion connecting the first sheet-shaped portion to the second sheet-shaped portion, the sheet-shaped wall portion forming an exterior wall of the printing head, wherein a thickness of a section of the wall portion connected adjacent to the second sheet-shaped portion is greater than a thickness of a section of the wall portion connected adjacent to the first sheet-shaped portion.

2. A printing head according to claim 1, wherein the wall portion includes a curved surface in the section connected adjacent to the second sheet-shaped portion.

3. A printing head according to claim 1, wherein a thickness of the wall portion simply increases toward the second sheet-shaped portion.

4. A printing head according to claim 1, wherein the wall portion includes a cavity formed in the section connected adjacent to the first sheet-shaped portion.

5. A printing head according to claim 1, wherein the wall portion includes a cavity formed in the section connected adjacent to the second sheet-shaped portion.

6. A printing head according to claim 1, wherein a beam is provided between the first sheet-shaped portion and the second sheet-shaped portion.

7. A printing head according to claim 1, wherein the first sheet-shaped portion includes a groove formed therein.

8. A printing head according to claim 1, wherein the first sheet-shaped portion forms a bottom face of the printing head and the wall portion forms a lateral face of the printing head, and the thickness of the section connected adjacent to the first sheet-shaped portion increases toward the inner side of the printing head.

9. A printing head according to claim 1, wherein the wall portion includes a first curved surface in the section connected adjacent to the first sheet-shaped portion and a second curved surface in the section connected adjacent to the second sheet-shaped portion, and a curvature radius of the first curved surface is smaller than that of the second curved surface.

* * * * *